US005146710A

United States Patent [19]

Caldwell

[11] Patent Number: 5,146,710

[45] Date of Patent: Sep. 15, 1992

[54] PARKING SPACE CONTROL

[76] Inventor: Wesley A. Caldwell, 17493 McGregor Blvd., Ft. Myers, Fla. 33908

[21] Appl. No.: 658,782

[22] Filed: Feb. 20, 1991

[51] Int. Cl.[5] ..... E05B 65/00

[52] U.S. Cl. ..... 49/35; 404/6; 49/132

[58] Field of Search ..... 49/49, 35, 131, 132, 49/133; 404/6, 7

[56] References Cited

U.S. PATENT DOCUMENTS

| | | | |
|---|---|---|---|
| 1,217,651 | 2/1917 | Sortland | 49/133 |
| 2,528,790 | 11/1950 | Scherer | 49/35 X |
| 2,581,788 | 1/1952 | Dunn . | |
| 2,588,502 | 3/1952 | Dunn . | |
| 2,622,354 | 12/1952 | Bacon | 49/132 X |
| 2,657,486 | 11/1953 | Sweetser . | |
| 3,667,160 | 6/1972 | Salloum | 49/35 |
| 3,688,439 | 9/1972 | Doxsee | 49/35 |
| 3,838,760 | 10/1974 | Selby, Jr. | 194/1 R |
| 4,641,459 | 2/1987 | Mesa | 49/35 |
| 4,822,206 | 4/1989 | Roussel et al. | 404/6 |
| 4,998,843 | 3/1991 | Mothe | 404/6 |

FOREIGN PATENT DOCUMENTS

| | | |
|---|---|---|
| 256033 | 6/1961 | Australia . |
| 2357713 | 7/1976 | France . |
| 87/00432 | 5/1988 | PCT Int'l Appl. . |
| 1022817 | 10/1964 | United Kingdom . |
| 1339892 | 12/1969 | United Kingdom . |
| 1436234 | 6/1973 | United Kingdom . |

*Primary Examiner*—Richard E. Moore
*Assistant Examiner*—Jerry Redman
*Attorney, Agent, or Firm*—Myron E. Click

[57] ABSTRACT

Apparatus for controlling access to a parking space which may utilize either a vehicle body or a tire access blocking barrier. In one embodiment a barrier is pivotally mounted on a parking space floor for movement between an upwardly extending and horizontal position. The barrier is held upright by a spring biased locking pin, which is retracted by a remote control by a vehicle driver to allow the barrier to fall to the horizontal position. Spaced forward and rear plates are pivotally mounted on the space floor and are connected by a bell crank linkage. So, when one plate is pivoted to the floor by a vehicle wheel driving over it, the other plate is pivoted to an upright position. A latch member is carried by the front plate which engages the barrier as the front plte is pivoted to the floor by wheel contact. The front plate and the engaged barrier are pivoted to an upright position when the vehicle backs out and pivots the rear plate to the floor.

20 Claims, 4 Drawing Sheets

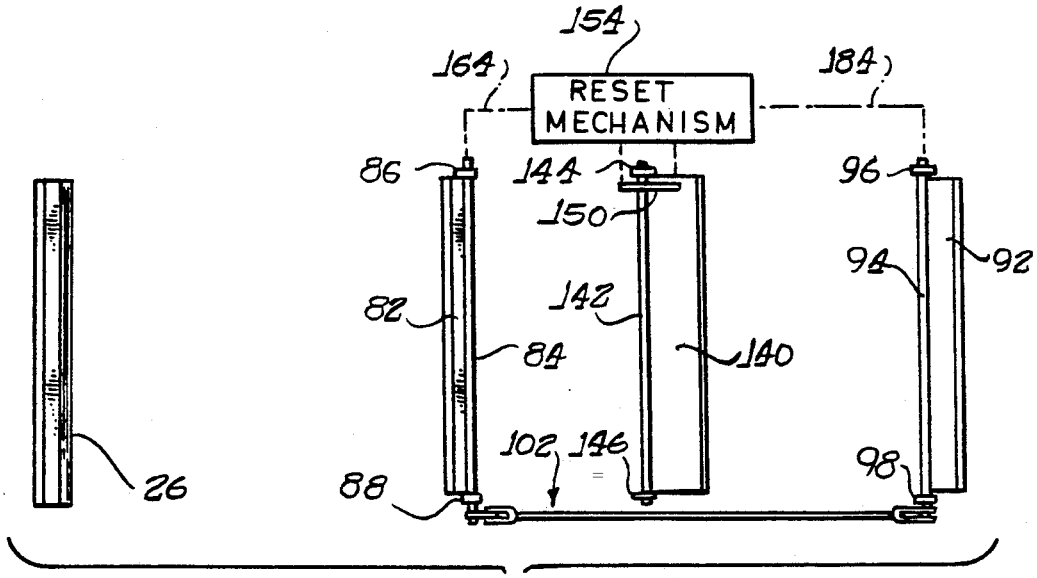
FIG.12
FIG.13
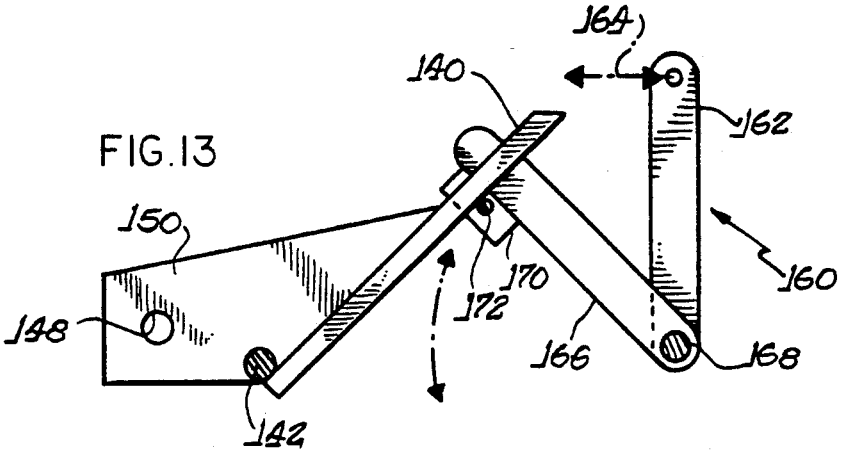
FIG.14
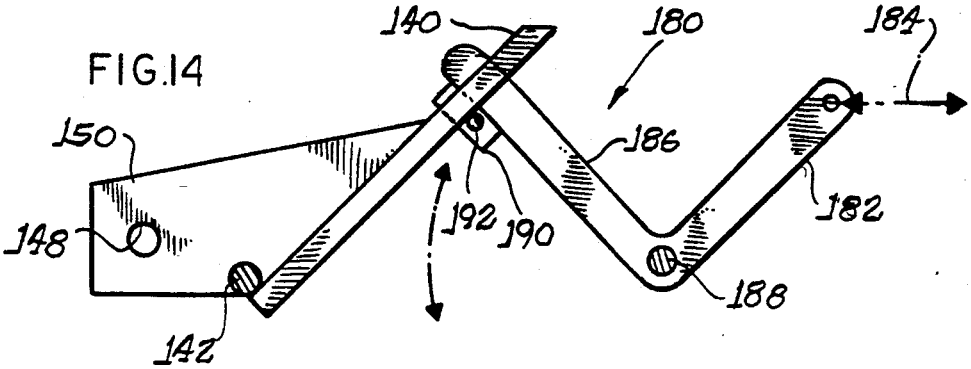

PARKING SPACE CONTROL

BACKGROUND OF THE INVENTION

1. Field of the Invention

This invention relates to apparatus for controlling the use of parking stalls or spaces in general and, in particular, to the control of individual parking spaces by reserving them for individual owners of the spaces or to charge a fee for use of individual spaces.

2. Description of the Prior Art

There have been a wide variety of devices for controlling uses of parking spaces. A plurality of parking spaces have been enclosed in a parking lot configuration, with entry to or exit from the parking lot controlled, usually by a coin collecting control operating device. Examples of such devices are disclosed in U.S. Pat. Nos. 2,581,788; 2,588,502 and 2,657,486, British Patent No. 1,339,892, and PCT/FR87/00432.

However, once inside the parking lot, a vehicle could be parked in any space that is empty. This is not always desirable, because certain spaces may be allocated to and in close proximity to certain businesses, condominium residences, and the like for the convenience of their employees, owners, etc.

Accordingly, there have been attempts to control the use of individual parking spaces by devices that permit free entry of a vehicle but require payment in order to leave the space. Examples of such devices are found in British Patents No. 1,022,817 and 1,436,234. However, these devices do not allow the reservation of the parking spaces for individual users.

The development of devices to permit reservation of individual parking spaces may be divided into two groups. First, there are those that use barriers that prevent entry by being tall enough to engage only the tires or wheels of the vehicles. Examples of tire barriers are found in U.S. Pat. No. 3,838,760 (FIG. 6) and in Australian Patent No. 256,033.

While barriers for car tires alone may be effective in some instances, they are difficult to see, e.g. in parking garages or unlighted parking lots. Even in good light, those with relatively poor vision and/or those who do not understand the system's operation may severely damage the parking control apparatus or their cars or both. The latter is particularly significant since there are other systems in which the tire barrier may be freely pushed down by the car tire when entering, but then will rise and lock to keep the car in the stall until a coin payment is made. Finally, there are areas where there is such a shortage of parking spaces that desperate drivers will jump or drive over tire barriers without regard to possible damage to the apparatus or their vehicles.

Therefore, larger and more visible barriers that can be seen above the hood of a vehicle and which appear to be capable of doing a substantial amount of damage to the auto body and radiator grill area serve a very important purpose. Examples of such auto body barriers for individual spaces, as opposed to parking lot entry control are found in U.S. Pat. 4,641,459 and French Patent No. 2,357,713.

However, larger and more visible auto body barriers may present unique problems in the design of such a system. It is desirable to have a basic system that could return both the auto body type barrier and the tire type barrier to an access blocking position from an entry permitting position, for maximum flexibility depending upon which type of barrier is desired in particular installations. The weight and bulk of an auto body barrier is more difficult to handle.

Thus, a manually operated device (U.S. Pat. No. 4,641,459); heavy duty electromagnetics requiring an expensive underground installation (French Patent No. 2,357,713); heavy duty spring, lever and hydraulics requiring an underground installation (U.S. Pat. No. 2,588,502); a manually operated barrier, again with a sub surface installation (PCT/FR87/00432); and the familiar pivoted and counter weighted barrier arm (may be too tall for some parking garage roofs) (British Patent No. 1,339,892), have been tried with the noted disadvantages.

In addition to resolving the above-noted problems, an ideal parking space reserving system would:

(1) move a barrier to an entry permitting position and reset the barrier automatically to an access blocking position without requiring the driver to get out of the vehicle or special driving skills, (2) be installable on already existing parking spaces without requiring an expensive underground installation, and which would allow the owner to dismantle the system and take it with him.

(3) not require any external power supplies for operation, whether electric, hydraulics, pressurized air, or the like, (4) be inexpensive to manufacture, assemble, install and maintain, (5) have very simple mechanical controls and operation for greater reliability, which would also help attain the goal of item (4) above, and (6) be flexible enough to operate both tire and auto-body type barriers.

None of the prior art devices meet all of the six goals set forth above, although some devices try to meet one or more of the above goals.

For example, Australian Patent No. 256,033, shows the use of a lever having a forward end connected to a tire barrier and a rear end which is cantilevered over a fulcrum, to raise the barrier when the vehicle leaves the space. The driver is required to drive into the space along the side of the lever. Then, when leaving the space, the driver must first turn the steering wheel so that one of the front tires will move out of the entry track toward and on top of the forward part of the lever. Then, as the vehicle backs out, the steering wheel must continually be adjusted to keep that front tire on top of the lever until it passes the fulcrum area. This requires considerable driving skill, because if that front tire falls off of the lever the barrier will not be reset.

Moreover, the Australian device requires a wider parking space. First, room must be provided for the addition of the lever system along the side of the space. Secondly, because the front tires must be turned before the vehicle can back out, the rear of the vehicle will immediately start to turn in the direction opposite to that in which the front tires are pointed. This will cause the front fender to swing wide in one direction while the rear of the vehicle will swing wide in the other direction, so the space must be wider to avoid contact with vehicles in adjoining parking spaces.

The apparatus in U.S. Pat. No. 2,657,486 is designed for drive-through control of entry into a parking lot, not for reservation control of a drive-in and back-out parking space. However, it does show a tire barrier operated by a tilting leaf which is responsive to successive tilts by wheels passing over it. This involves a complex and expensive mechanism which requires electrical power and is expensive to manufacture, assemble and maintain. Finally, the apparatus cannot be used with an auto-body type barrier because the apparatus raises the barrier beneath the car which, while acceptable for a short tire-type barrier, would not be acceptable for a taller auto-body type which couldn't raise to its upright position and/or would get hung up on the under-body of a vehicle.

Accordingly, it is an object of this invention to provide an improved parking space control apparatus.

It is a further object of this invention to provide improved apparatus for reserving a parking space for use by authorized personnel which has all of the six sets of advantages listed hereinbefore.

Other objects, advantages and features of this invention will become apparent when the following description is taken in conjunction with the accompanying drawings.

SUMMARY OF THE INVENTION

An improved apparatus for controlling access by wheeled vehicles to a parking space is disclosed which may be used with either a tire-type barrier or a vehicle body-type barrier. Thus, a movably mounted barrier is described which is adapted for movement between access blocking and entry permitting position for restricting use of the parking space by wheeled vehicles.

A control is operable by an authorized user from a vehicle trying to enter the space for actuating movement of the barrier from access blocking to an entry permitting position.

The barrier is automatically reset back to an access blocking position when a vehicle leaves the parking space. Movable members are disposed in spaced relationship for successive selective contact with at least one vehicle wheel following a path defined by entry and exit of a vehicle.

The spaced members are connected by means adapted to move one of the members from an inactive position to an active position in the wheel path in response to wheel contact moving another member disposed in the path to an inactive position. The barrier is moved back into access blocking position by means operable by movement of one of the spaced members in response to wheel contact with a member as a vehicle leaves the parking space.

The automatic resetting of the barrier is enabled by entry of a wheeled vehicle into the space. The entry disposes the movable members by wheel contact into positions with respect to the wheel path, whereby the other of the members is disposed for wheel contact as the wheel leaves the space.

The spaced movable members may include forward and rear members pivotally mounted on the floor of the parking space. The means connecting the spaced members is adapted to move one of the members to an upwardly extending position when the other of the members is moved to a substantially horizontal position, and vice versa.

In order to move the barrier back to an access blocking position, means are provided for enabling a link between one of the forward and rear members and the barrier. This allows movement of one of the members in response to wheel contact by a vehicle leaving the parking space to move the barrier linked therewith back to access blocking position.

The link enabling means may be carried by one of the barrier and forward members, so that when the forward member is moved to an upwardly extending position the barrier is moved to access blocking. Alternatively, the link enabling means may be carried by one of the rear member and barrier, so that when the rear member is moved to the horizontal position the barrier linked therewith is moved to access blocking.

In the preferred embodiment, the barrier is movably mounted in the parking space, and the access blocking position is an upwardly extending position to physically block the vehicle body from entering the space. The entry permitting position in this embodiment is substantially horizontal. More specifically, the barrier may be pivotally mounted, and the control means includes means for allowing the barrier to pivot to the horizontal position. The control means may include locking means for maintaining the barrier in the upward position and means for releasing that locking means.

In another embodiment, the barrier may be a wheel engaging or tire-type barrier. The tire-type barrier is operated by the same type of apparatus as the vehicle body-type barrier.

BRIEF DESCRIPTION OF THE DRAWINGS

In the drawings, where like numerals are employed to designate like parts throughout:

FIG. 12 is a plan view of a second type of an access blocking barrier;

FIG. 13 is a side elevational view of a first device for operating the barrier shown in FIG. 12; and FIG. 14 is a side elevational view of a second device for operating the barrier shown in FIG. 12.

DESCRIPTION OF THE PREFERRED EMBODIMENTS

Figures 1, 2:
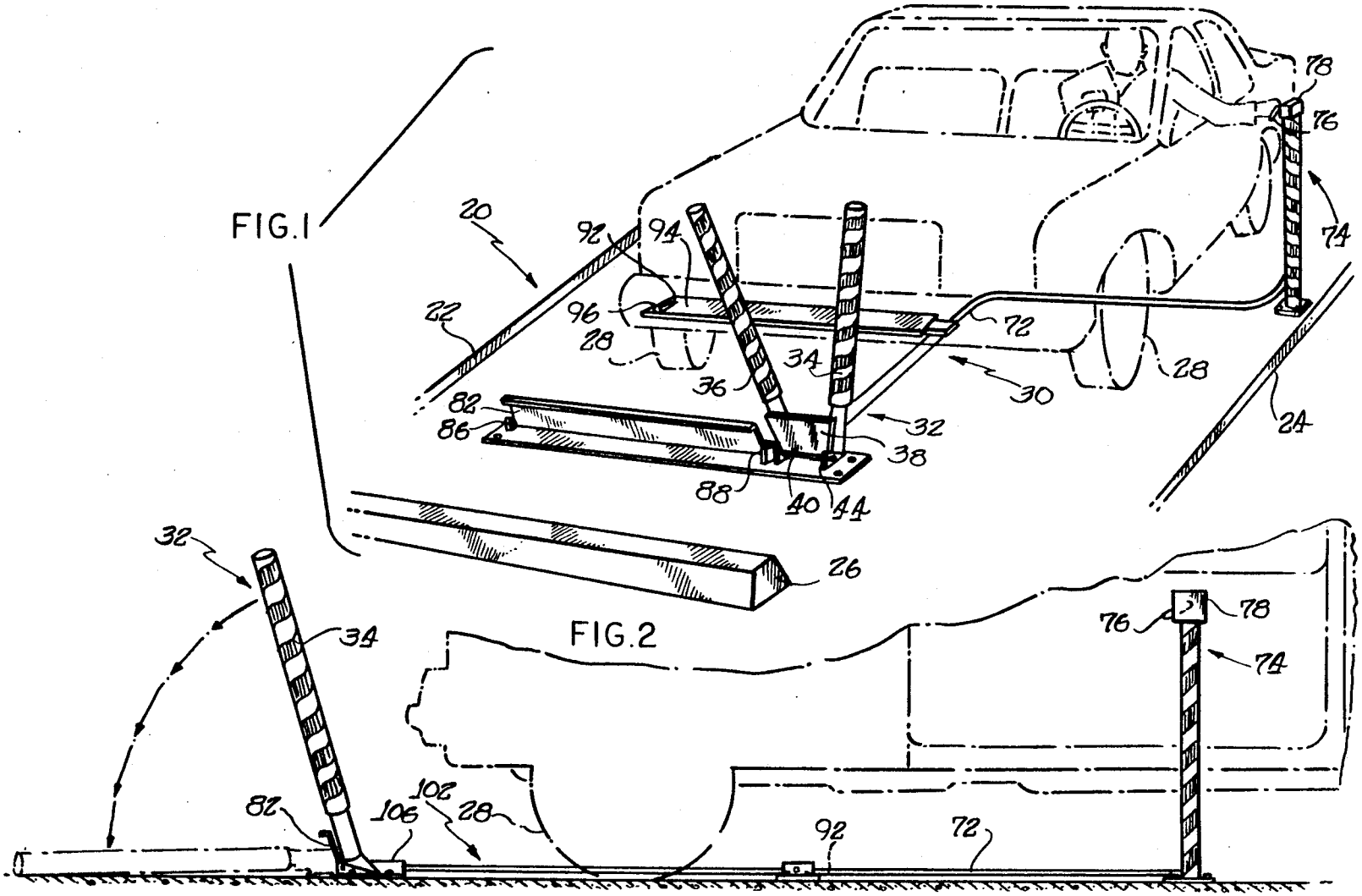
FIG. 1 is a perspective view of a vehicle waiting to enter a parking space controlled by this invention.
FIG. 2 is a side view of the apparatus shown in FIG. 1.

Referring now to FIGS. 1 through 5 there are shown various views of a parking space access control apparatus 30. In general, the apparatus operates as follows. In FIGS. 1 and 2 a vehicle with wheels 28 pulls up to the entry of a parking space generally indicated at 20, with lines 22 and 24 defining the sides of the space and a tire stop bumper 26 defining the forward end of the space.

Figure 3:
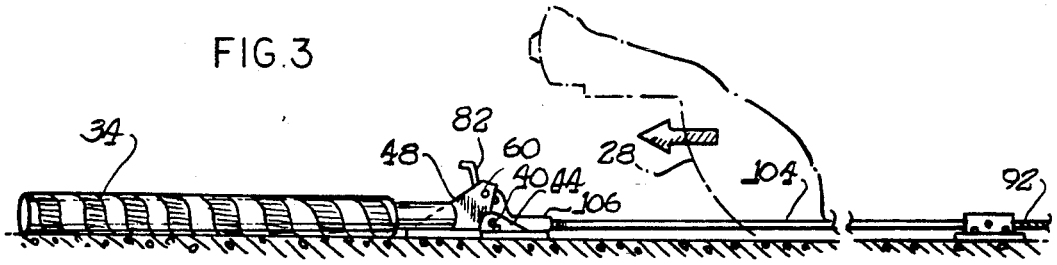
FIG. 3 is a partial view of FIG. 2 showing a barrier in an entry permitting position.
Figure 5:
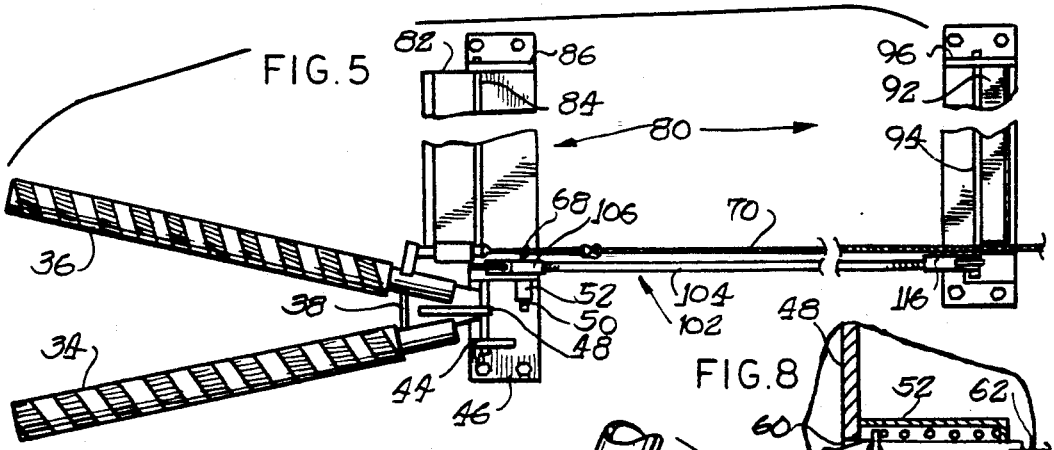
FIG. 5 is a plan view of the parking space and apparatus shown in FIG. 4.
Figure 4:
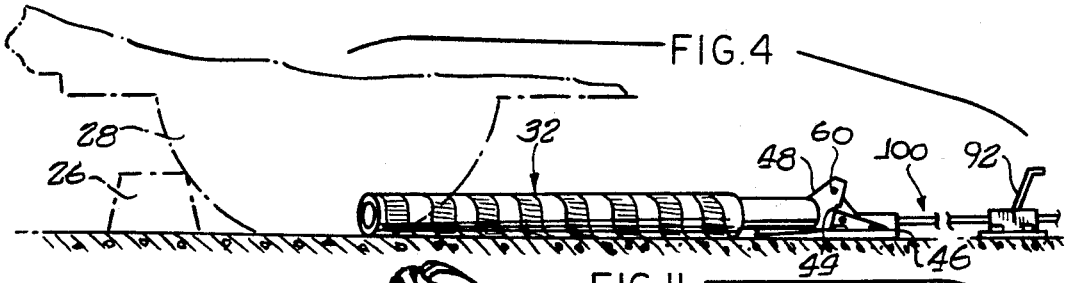
FIG. 4 is also a partial view of FIG. 2 showing a vehicle fully advanced into the parking space above the barrier.

In a preferred embodiment, the driver operates a remote control generally indicated at 74 by using a key operated mechanism 78 to free handle 76 for rotation. The handle 76 may also be freed to rotate by a coin operated or similar mechanism which permits only authorized users to enter the parking space. When handle 76 is rotated, cable 70, best seen in FIG. 6, retracts a locking pin 50 and a latch pin 128 to allow a barrier generally indicated at 32 to fall from an upwardly extending and access blocking position (FIGS. 1 and 2) to a substantially horizontal and entry permitting position (FIGS. 3, 4 and 5). The driver then advances into the parking space as shown in FIGS. 3 and 4.

In order to raise the barrier 32 back up to the access blocking position, a vehicle wheel-operated pivoting system (generally indicatd at 80 in FIG. 5) is provided. The system 80 includes pivotally mounted forward and rear plate 82, 92, and a bell crank connecting means generally indicated at 102. When one of the pivot plates 82, 92 is pivoted to a horizontal position the connecting means 102 raises the other plate to an upwardly extending position.

In this embodiment, the forward plate 82 is located adjacent to the pivoting barrier 32, and is in the upright position before entry of a vehicle, as shown in FIGS. 1, 2 and 3. As the vehicle advances from the position in FIG. 3 to the position in FIG. 4, a wheel 28 passes over and pivots plate 82 to the horizontal position. In so doing, the latch pin 128 is cammed against spring 130 by contact with a lifting bar 124 on the barrier, until past bar 124 when spring 130 urges pin 128 behind bar 124.

As wheel 28 pivots forward plate 82 to the ground, the connecting means 102 pivots rear plate 92 to an upright position. Thus, when the vehicle backs out, wheel 28 pivots rear plate 92 to the ground thereby pivoting plate 82 back up to an upright position. Since latch pin 128 is held behind lifting bar 124 (secured to barrier 32) by spring 130, the latch pin 128 carried on plate 82 lifts barrier 32 as plate 82 pivots to an upright position. The locking pin 50 engages the barrier 32 to retain it in the access blocking position, and the parking space control apparatus 30 is reset to be ready for the next use of the parking space.

The structural details of the parking space control apparatus 30 will now be described. The barrier 32 is the auto-body type described hereinbefore as preferable for most installations. Two upright standards 34, 36 are attached to a support plate 38 in a v-shaped configuration by welding, bolts or the like, and extend above hood level with high visibility. The standards may have spirally wrapped fluorescent tape to further enhance their visibility, particularly after dark.

The support plate 38 is mounted on shaft 40 which is journally supported in spaced bushings or bearings 42, 44 mounted on floor plate 46 secured to the floor of the space 20. The barrier 32 is thus pivotally mounted for movement between upwardly extending and substantially horizontal positions. In this embodiment the barrier 32 is held in the upright position at an angle of less than ninety degrees so that release of the locking pin 50 allows the barrier 32 to be pulled to the horizontal position by gravity.

Figure 6:
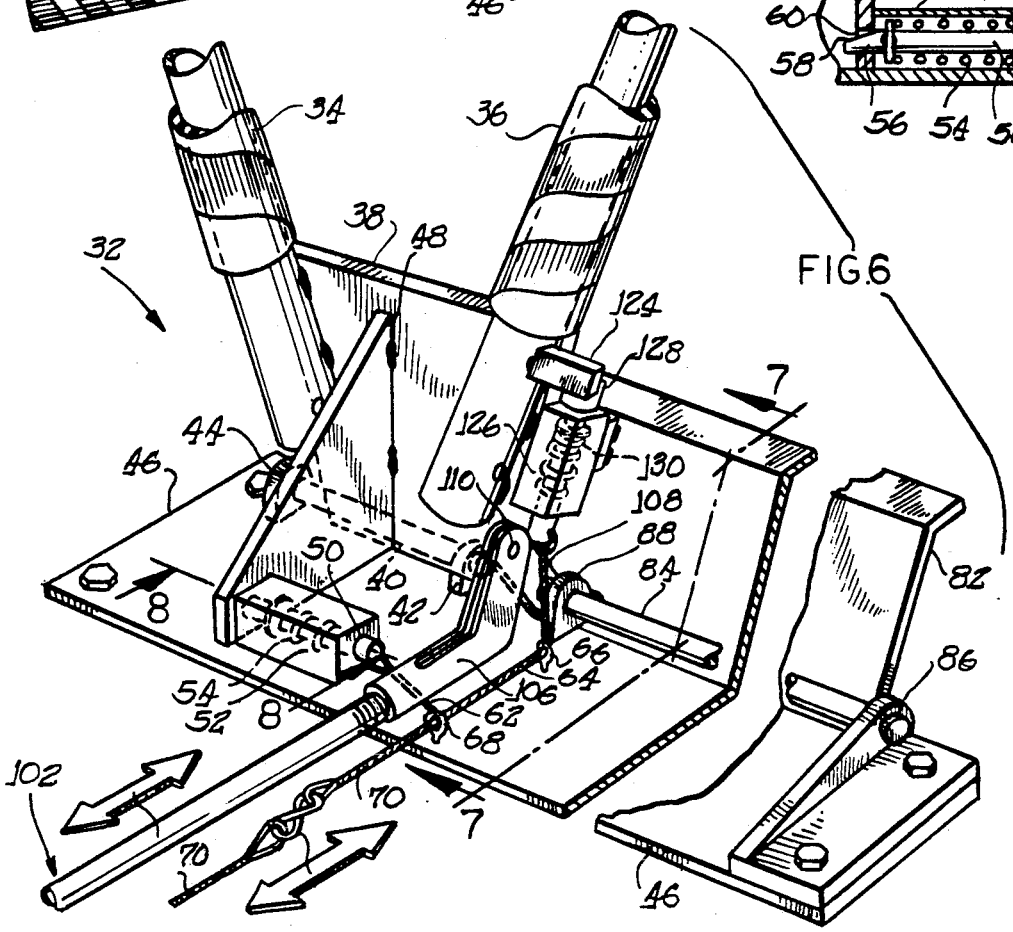
FIG. 6 is a view in perspective of details of the barrier and a forward pivot plate for lifting it back into access blocking position.

Means for selectively maintaining the barrier 32 in the upwardly extending position is best seen in FIG. 6 and include a holding plate 48 which is welded or otherwise secured to the support plate 38 and extends toward the rear of the space 20. The junction of the holding plate 48 with support plate 38 defines an angle of less than ninety degrees with respect to the space floor to tilt the barrier as described above.

Figure 8:
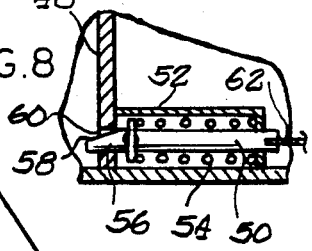
FIG. 8 is a cross-sectional view of a locking pin apparatus taken along line 8—8 in FIG. 6.

The rear of holding plate 48 has a hole 60 formed therein to receive and retain the nose 56 of locking pin 50, the pin 60 being journally supported in a pin block 52 secured to mounting plate 46. The pin 50 is yieldingly urged toward holding plate 48 by spring 54. As best seen in FIG. 8, pin 50 has a chamfered or cam surface 58 formed on the nose 56. As the barrier 32 is pivoted toward the upright position, the bottom of the holding plate 48 contacts the cam surface 58 and pushes pin 50 backward against the bias of spring 54 until pin 50 clears the bottom of plate 48. The plate 48 then slides by the nose 56 until hole 60 is aligned therewith and receives nose 56 therein to lock the barrier 32 in place.

The selective maintaining means is released by key actuating mechanism 78 freeing handle 76 for rotation. Cable 70 runs through cable guide 72 from handle 76 to guide eyelet 68 to cable segments 62 and 64. Cable segment 62 is attached to pin 50. Cable segment 64 extends through guide eyelet 66 and is attached to latch pin 128. Rotation of handle 76 retracts pins 50 and 128 against the bias of springs 54 and 130 to release barrier 32 to pivot to the floor. By releasing the restraint against the pull of gravity, the control means 74 actuates the movement of the barrier 32 from access blocking to entry permitting position.

Means for resetting the barrier 32 to access blocking position includes the pivoting system generally designated at 80 in FIG. 5 and means for enabling a link between the barrier 32 and the pivoting means 80—shown as latching means 126 which is best seen in FIGS. 6 to 10.

Figure 11:
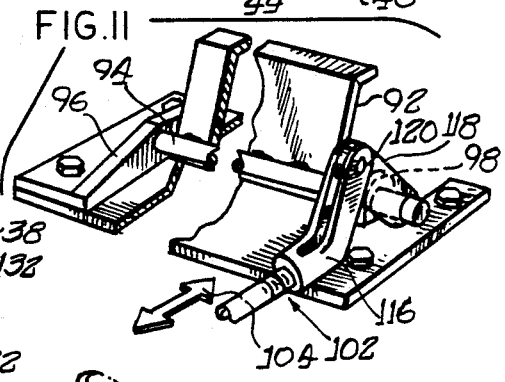
FIG. 11 is a view in perspective of a rear control pivot plate.

The pivoting system 80 includes forward plate 82 welded or otherwise secured to shaft 84 which is journalled in spaced bushings or bearings 86, 88 on floor plate 46. Rear plate 92 is welded or otherwise attached to shaft 94 which is journalled in spaced bushings 96, 98 on a floor support plate—as best seen in FIG. 11.

A connecting means 102 for plates 82, 92 includes a connecting rod 104 having a forward connecting arm 106 and a rear connecting arm 116 secured to opposite ends thereof. Bell crank arms 108, 118 are secured to the ends of shafts 84, 94 respectively. The connecting arms 106, 116 are tilted upwardly toward arms 108, 118 to enable pivotal connections 110, 120 between connecting arms 106, 116 and crank arms 108, 118.

When the forward plate 82 is pivoted from an upright to horizontal position by entry of a vehicle, crank arm 108 is rotated forward, pulling the connecting rod 104 forward via pivotal connection 110. In turn, as rod 104 moves forward crank arm 118 is pulled forward, thus rotating shaft 94 to pivot rear plate 92 from a horizontal position to an upright position. When the vehicle exits, this action is reversed to bring forward plate 82 upright in response to movement of rear plate 92 from upright to horizontal position as wheel 28 exits.

Thus, the spaced members 82, 92 are disposed for successive selective contact with at least one vehicle wheel following a path defined by the entry and exit track of a vehicle wheel. The spaced members are moved between upright (active) and horizontal (inactive) positions. The active positions enable a positive response to wheel entry or exit.

The link enabling means in this embodiment includes a lifting bar 124 carried by the barrier 32 and a latching means 126 carried on the forward plate 82. However, the positions of these means could be reversed and still perform the function required.

Figure 7:
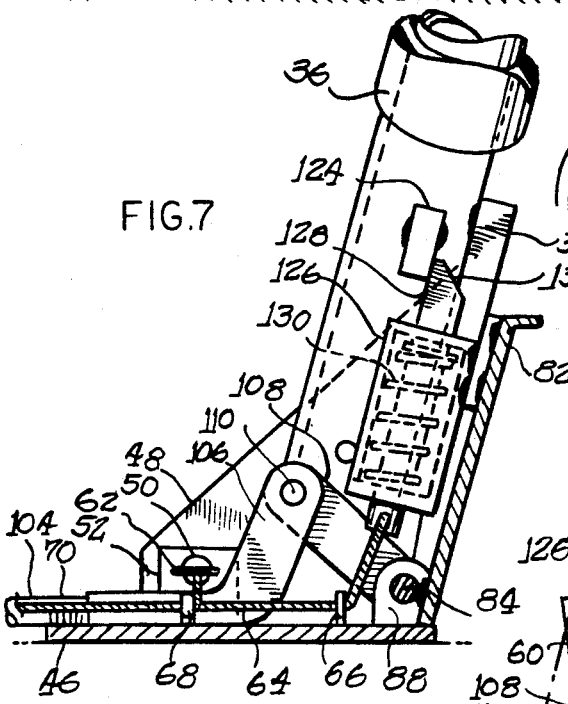
FIG. 7 is a cross-sectional view of the apparatus taken along line 7—7 in FIG. 6.
Figure 9:
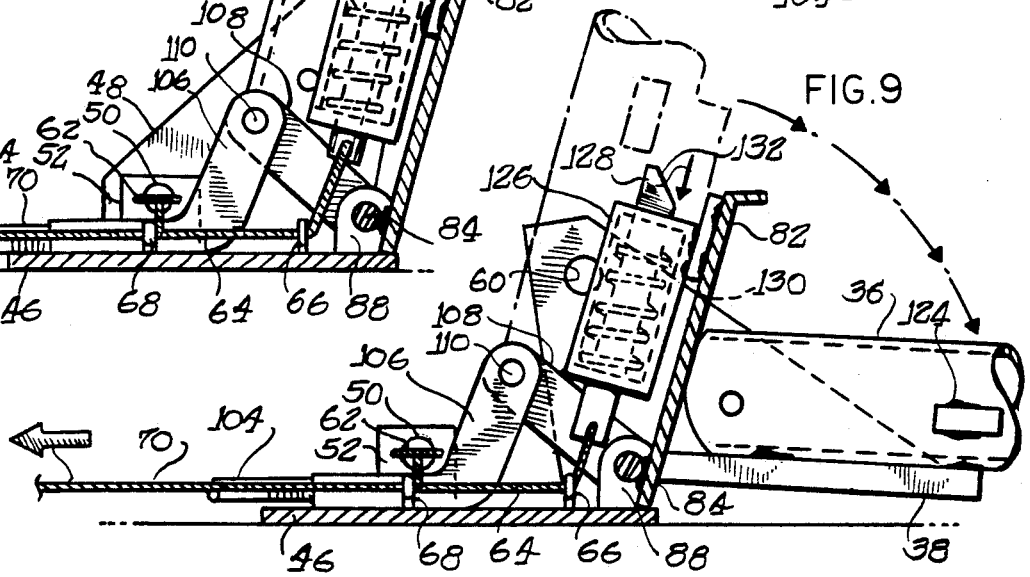
FIG. 9 is the cross-sectional view of FIG. 7 showing the barrier in an entry permitting position.
Figure 10:
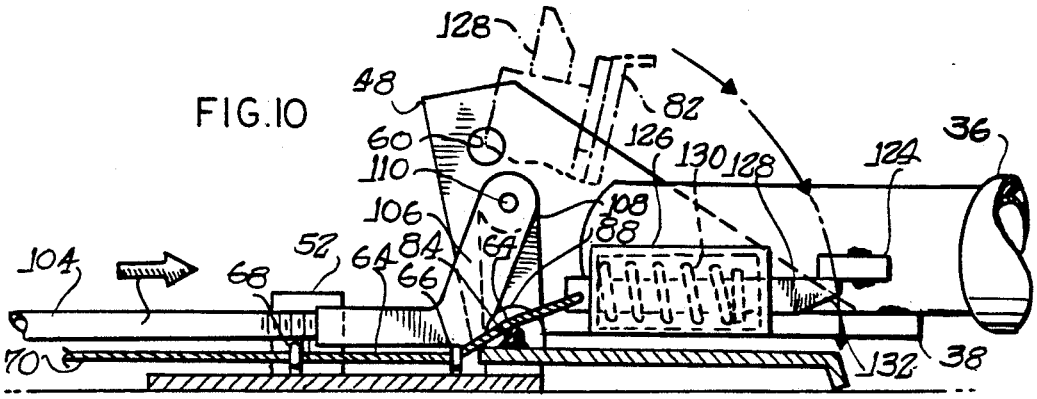
FIG. 10 is the cross-sectional view of FIG. 9 showing the barrier lifting means deployed to lift the barrier.

The latching means 126 includes a latch pin 128 journally carried on plate 82 and yieldingly urged toward the lifting bar 124 by spring 130. As best seen in FIGS. 7, 9 and 10 the nose of pin 128 has a chamfered or cam surface 132 formed thereon.

The latch pin 128 is retracted via cable segment 64 at the same time as cable segment 62 retracts locking pin 50, to release barrier 32 to fall from an upright to a horizontal position. In response to vehicle entry, plate 82 is also pivoted to a horizontal position. Cam surface 132 engages the upper side of lifting bar 124 and pushes latch pin 128 backward against spring 130 until pin 128 clears the bar 124. As the plate 82 continues downward, the pin 128 is urged by spring 130 behind lifting bar 124 when pin 128 clears bar 124. This enables a mechanical link whereby barrier 32 is lifted by engagement with pin 128 as forward plate 82 is pivoted back to an upright position. The weight of the vehicle insures a positive engagement.

Turning now to FIGS. 12, 13, and 14, there is shown a second embodiment of this invention in which use of a tire or wheel type barrier is disclosed using two different approaches for resetting the wheel barrier to an access blocking position.

FIG. 12 is a plan view of the second embodiment, in which some details of the mechanism are shown which are already described in previous drawings and hereinbefore in the specification. However, where appropriate, the same reference numerals are employed for easier identification of the components. The pivoted forward and rear plates or members 82, 92 are connected by the same connecting means 102 which operates in the same manner as previously described.

A wheel or tire barrier plate 140 is shown in FIG. 12 in a substantially horizontal position to permit entry of a vehicle. Barrier 140 is welded or otherwise attached to a shaft 142 which is journally supported in spaced bushings or bearings 144, 146 for pivoting of the barrier 140 between the substantially horizontal position in FIG. 12 and the upwardly extending access blocking position shown in FIGS. 13 and 14, to engage wheels or tires to prevent entry to the parking space. A reset mechanism is illustrated in diagrammatic and block diagram form in FIG. 12, with two different forms of the mechanism being indicated generally at 160 and 180 in FIGS. 13 and 14, respectively.

Referring now to FIG. 13, the wheel barrier 140 is shown in the upwardly extending position to engage a wheel of a vehicle to prevent entry to the parking space. A hole 148 is formed in a retainer plate 150 which is secured to the back or top of baffle 140. The hole 148 is to receive a spring biased locking pin to retain the barrier 140 in the upright access blocking position in the same manner as locking pin 50 in FIG. 8.

Similarly, a latching means 170 has a spring biased latch pin 172 which is used to lift barrier 140 from a horizontal to an upright position. The same control means as indicated generally at 74 in FIGS. 1 and 2 can be used to retract a locking pin from pin retainer hole 148 and latching pin 172 from beneath barrier 140 to allow gravity to pull barrier 140 to fall to the floor of the parking space and allow passage of a vehicle over the barrier.

As a vehicle enters the space the front wheel passes over horizontal rear plate 92 and horizontal barrier 140, and then pivots the forward plate 82 from an upright to a horizontal position. As the front member or plate 82 is pivoted down, the connecting means 102 raises the pivotal rear member or plate 92 to an upright position.

In FIG. 13 a bell crank generally indicated at 160 has crank arms 162, 166 and a shaft 168 which is pivotally mounted on the floor of the space. The bell crank 160 also has pivotal means at the upper end of arm 162 for connecting the bell crank 160 by a mechanical link diagramatically noted at 164 in FIGS. 12 and 13 to the shaft 84 of the forward plate 82. This connection may be in the same crank arm manner as already described hereinbefore with respect to crank arm 108 in FIG. 6. Whatever mechanical linkage is selected, the function of link 164 is to pull crank arm 162 to the left in FIG. 13 as the forward plate 82 is pivoted from an upright to a horizontal position. Conversely, the crank arm 162 will be pushed to the right as plate 82 is pivoted from the horizontal to an upright position.

As the tire or wheel pivots forward plate 82 to the ground crank arm 162 is pulled to the left and pivots crank arm 166 to the floor of the space. The latch pin 172 of the latch 170 carried on arm 166 has a chamfered or cam surface similar to that already shown at 132 in the first embodiment to push the pin back until it is again urged forward by spring force beneath the horizontal barrier 140. Thus, a link is enabled between the pivoting forward member 82 and the barrier 140.

As the vehicle exits, the wheel passes over the horizontal plate 82, horizontal barrier 140 and the now upright rear plate 92 pivoting it to a horizontal position, thereby bringing forward plate 82 to an upright position. This pivots crank arm 162 to the right in FIG. 13, lifting crank arm 166 and thereby also the latch pin engaged barrier 140 to an upright access blocking position.

The apparatus shown in FIG. 14 provides the same function of lifting barrier 140 to an upright access blocking position, except that it is operated by the rear pivot plate 92. The barrier 140 in FIG. 14 is retained in the upright access blocking position, and relased to an entry permitting position, in the same manner as in FIG. 13.

A bell crank generally indicated at 180 has crank arms 182, 186 and a shaft 188 which is pivotally mounted on the floor of the space. The bell crank 180 also has pivotal means at the upper end of arm 182 for connecting the bell crank 180 by a mechanical link diagramatically noted at 184 in FIGS. 12 and 14 to the shaft 94 of the rear plate 92. Again, as discussed with respect to FIG. 13, this connection may be in the same crank arm manner as already described hereinbefore with respect to crank arm 118 in FIG. 11. The function of link 184 is to pull crank arm 182 to the right in FIG. 14 as the rear plate 92 is pivoted from the upright to the horizontal position. Conversely, the arm 182 is pushed to the left as rear plate 92 is pivoted from horizontal to upright.

When barrier 140 is released, it pivots to the floor of the space. A vehicle can now enter over the horizontal rear plate 92 and horizontal barrier, to pivot the forward plate 82 from the upright to horizontal. In response to the position switch of forward plate 82, the rear plate 92 moves from the horizontal position to upright, thus pushing crank arm 182 to the right. The latch pin 192 of latch 190 carried on crank arm 186, engages barrier 140 as described above with respect to latch pin 172 and latch 170 in FIG. 13. As the vehicle exits, the passage of a wheel over the upright rear plate 92 pivots plate 92 to the horizontal, pulling crank arm 182 to the right. Crank arm 186 lifts latch pin 192 and engaged barrier 140 back up to access blocking position.

While the choice of the specific components and their arrangement in the preferred embodiments described hereinbefore provide the best results and advantages over the prior art, the invention is not limited to those specific components and their arrangement. For example, although flat plates are used for the forward and rear members, other structures could be used, e.g. open rectangular frames. Further, although the arrangement of the flat plates pivotally mounted on the floor is believed to be the superior set up with many advantages, there are pivotal arrangements that would place sensing members in the wheel path that could accomplish the same functions, e.g. being pivotally mounted on a vertical axis where a wheel could push one member out of the path to an inactive position causing the other member to be pushed into the path in an active wheel sensing position. Still further, the barrier could be mounted in a position other than pivotally on the floor, although that mounting provides preferred advantages.

Therefore, the form of the invention herein shown and described is to be taken as illustrative only, and changes in the shape, size and arrangement of the components, parts or portions may be made without departing from the spirit and scope of the invention.

There has thus been disclosed apparatus which differs structurally from, provides functions not performed by, and has clear advantages over the apparatus of the prior art.

I claim:

1. Apparatus for reserving a parking space for use by authorized users, comprising:

(a) movably mounted barrier means adapted for movement between access blocking and entry permitting positions for restricting use of a parking space by wheeled vehicles, (b) control means, operably by an authorized user from a vehicle trying to enter said space, for actuating movement of said barrier means from access blocking position to entry permitting position, and (c) means for automatically resetting said barrier means back to an access blocking position including first and second spaced movable members disposed for successive selective contact with at least one vehicle wheel following a path defined by entry and exit of a vehicle, means for connecting said spaced members whereby each member is moved from an inactive to an active position for future contact with and movement by wheel contact in response to wheel contact moving the other member from an active to an inactive position, and means operable by movement of one of said members in response to wheel contact with a member as a vehicle leaves said space for moving said barrier means back into access blocking position.

2. Parking space reserving apparatus as defined in claim 1 in which entry of a wheeled vehicle into said space disposes said movable members by wheel contact into positions with respect to said path whereby said other of said members is disposed for wheel contact as said vehicle leaves said space to enable said barrier means to be moved back into access blocking position.

3. Parking space reserving apparatus as defined in claim 1 in which said spaced movable members include forward and rear members pivotally mounted on the floor of said space, and in which said means connecting said members is adapted to move one of said members to an upwardly extending position when the other of said members is moved to a substantially horizontal position, and vice versa.

4. Parking space reserving apparatus as defined in claim 3 in which said means for moving said barrier means back to access blocking position in response to wheel contact includes means for enabling a link between one of said forward and rear members and said barrier means, whereby the movement of one of said members in response to wheel contact by a vehicle leaving said space moves said barrier means linked therewith back to said access blocking position.

5. Parking space apparatus as defined in claim 4 in which said link enabling means is carried by one of said barrier means and said forward member, and in which movement of said forward member to an upwardly extending position moves said barrier means linked therewith back to said access blocking position.

6. Parking space apparatus as defined in claim 4 in which said link enabling means is carried by one of said barrier means and said rear member, and in which movement of said rear member to a substantially horizontal position moves said barrier means linked therewith back to said access blocking position.

7. Parking space reserving apparatus as defined in claim 1 in which said barrier means is movably mounted in said parking space, and in which said access blocking position is an upwardly extending position to physically block the vehicle body from entering said space, and in which said entry permitting position of said barrier means is substantially horizontal.

8. Parking space reserving apparatus as defined in claim 7 in which (a) said barrier means is pivotally mounted on the floor of said space, and in which (b) said control means includes means for allowing said barrier means to pivot to a substantially horizontal position.

9. Parking space reserving apparatus as defined in claim 7 which further includes (a) locking means for maintaining said barrier means in said upwardly extending position, and in which (b) said control means includes means for releasing said locking means to allow said barrier means to pivot to a substantially horizontal position.

10. Parking space reserving apparatus as defined in claim 1 in which said barrier means is pivotally mounted in said space, and in which said access blocking position is an upwardly extending position to engage a wheel of a vehicle to prevent entry, and in which said entry permitting position is substantially horizontal.

11. Apparatus for controlling access by wheeled vehicles to a parking space, comprising;

(a) barrier means mounted on a parking space floor for movement between an upwardly extending position and a substantially horizontal position for blocking access and permitting entry, respectively, (b) means for selectively maintaining said barrier means in said upwardly extending position, (c) control means actuatable from a vehicle for releasing said selective maintaining means to allow said barrier means to move to said substantially horizontal position, and (d) means for resetting said barrier means back to said upwardly extending position including a pivoting means mounted on said floor for moving said barrier means to said upwardly extending position and means for enabling a link between said barrier means and said pivoting means, (e) said pivoting means including a forward pivotal member, a rear pivotal member spaced from said forward member toward the entry of said space, and means connecting said forward and rear members for pivoting one of said members to an upwardly extending position when the other of said members is pivoted to a substantially horizontal position in response to contact with a vehicle wheel.

12. Apparatus as defined in claim 11 in which;

(a) said link enabling means includes means carried by one of said barrier means or one of said forward and rear pivotal members for engaging the other of said barrier means or said one of said forward and rear pivotal members, (b) the movement of said one of said forward and rear members to an upwardly extending position or substantially horizontal position, respectively, pivoting said engaged barrier means to said upwardly extending position.

13. Apparatus as defined in claim 12 in which said control means is further connected to also release said link enabling means to allow said barrier means to pivot to said substantially horizontal position.

14. Apparatus as defined in claim 11 in which said link enabling means includes latching means for selectively providing a mechanical link, said latching means including a yieldingly biased latch member operated by contact to engage in response to vehicle wheel contact with one of said forward and rear members thus insuring positive engagement.

15. Apparatus as defined in claim 11 in which (a) said forward member is located adjacent to said barrier means, and (b) said link enabling means includes a yieldingly biased latch member carried by one of said barrier means and said forward member, whereby when said barrier means is in said horizontal position and said forward member is in an upwardly extending position the contact with an entering vehicle wheel will move said forward member to said horizontal position to operate said latch member and provide mechanical link between said barrier means and said forward member.

16. Apparatus as defined in claim 11 in which (a) said forward and rear members are located remotely from said barrier means, (b) said link enabling means includes a yieldingly biased latch member, and (c) said pivoting means further includes pivotal linkages, (d) one of said barrier means and said pivotal linkages carrying said latch member.

17. Apparatus as defined in claim 11 in which said barrier means is held at an angle less than ninety degrees in the upwardly extending position with respect to said space floor, whereby release of said selective maintaining means allows said barrier means to be pulled toward said horizontal position by gravity.

18. Apparatus as defined in claim 11 in which said control means includes (a) manually operable means for mechanically releasing said barrier means, and (b) key operated means for enabling use of said manually operable means.

19. Apparatus as defined in claim 11 in which said selectively maintaining means includes, (a) a locking member journally secured to the space floor and means for yieldingly urging said locking member toward said barrier means when said barrier means is in said upwardly extending position, and (b) locking member retaining means carried by said barrier means for receiving said locking member.

20. Apparatus as defined in claim 11 which further includes means for resetting said selectively maintaining means to retain said barrier means when said barrier means is pivoted back to said upwardly extending position.

* * * * *